US005129564A

United States Patent [19]

Danezin

[11] Patent Number: 5,129,564

[45] Date of Patent: Jul. 14, 1992

[54] CARRYING ARRANGEMENT HAVING AN ENCLOSED ADJUSTMENT DEVICE

[75] Inventor: Jean-Bruno Danezin, Seyssel, France

[73] Assignee: Salomon S.A., Annecy Cedex, France

[21] Appl. No.: 611,016

[22] Filed: Nov. 9, 1990

[30] Foreign Application Priority Data

Nov. 29, 1989 [FR] France ..... 89 16070

[51] Int. Cl.[5] ..... A41F 15/02; A45F 3/14

[52] U.S. Cl. ..... 224/264; 224/257; 150/108

[58] Field of Search ..... 224/264, 258, 257, 202, 224/265, 150, 151, 205; 24/163 FC, 184; 150/108; 206/315.2, 315.3, 315.4, 315.5, 315.6, 315.7, 315.8

[56] References Cited

U.S. PATENT DOCUMENTS

| | | | |
|---|---|---|---|
| D. 308,441 | 6/1990 | Quellais | D3/37 |
| 502,792 | 8/1893 | Vollmar | 24/184 |
| 1,271,784 | 7/1918 | Simpson | 206/315.6 |
| 1,570,510 | 1/1926 | McQuirk | 206/315.4 |
| 1,621,107 | 3/1927 | Cross . | |
| 1,928,922 | 10/1933 | Adams . | |
| 2,676,737 | 4/1954 | Zirbel | 224/264 |
| 2,707,009 | 4/1955 | Cook | 224/202 |
| 2,711,201 | 6/1955 | Hotze . | |
| 2,808,188 | 10/1957 | Chlumsky | 224/264 |
| 2,861,614 | 11/1958 | Kish, Jr. | 224/202 |
| 2,863,483 | 12/1958 | Fargo | 211/70.2 |
| 3,435,867 | 4/1969 | Hyden | 224/264 |
| 3,521,689 | 7/1970 | Woods, Jr. | 383/4 |
| 4,249,586 | 2/1981 | Setani . | |
| 4,334,564 | 6/1982 | Clayton | 150/1.5 C |
| 4,815,640 | 3/1989 | Johnson | 224/202 |

FOREIGN PATENT DOCUMENTS

| | | |
|---|---|---|
| 2595220 | 9/1987 | France . |
| 400350 | 11/1933 | United Kingdom . |
| 1315943 | 5/1973 | United Kingdom . |

*Primary Examiner*—Henry J. Recla
*Assistant Examiner*—David J. Walczak
*Attorney, Agent, or Firm*—Sandler, Greenblum & Bernstein

[57] ABSTRACT

A carrying arrangement for a shoulder pad for a carrying strap of a bag, such as a golf bag. The shoulder pad is connected at an upper point and at a lower point on the bag and is configured as an elongated pocket. The pocket is accessible by means of a closure apparatus and encloses an apparatus for adjusting the effective length of the strap. By means of the configuration of the pocket which encloses the adjustment apparatus, no strap ends remain which might otherwise disturb the golfer or carrier of the bag.

21 Claims, 4 Drawing Sheets

651
65
61
651
21
61
62
211
63
64
65

65
221
221
22
22
641
652

21
64
641
22

CARRYING ARRANGEMENT HAVING AN ENCLOSED ADJUSTMENT DEVICE

BACKGROUND OF THE INVENTION

1. Field of the Invention

The present invention is related to bags, and more particularly to bags used to transport clubs and/or other accessories when practicing golf, and to the support element on the shoulder, referred to as a shoulder pad in what follows, and which are equipped with a shoulder strap or a carrying strap for such bags.

2. Description of the Background and Relevant Information

The type of bag referred to above is generally in the form of an elongated tube, which is more or less cylindrical, for holding clubs, and most often having pockets, on its exterior surface, for holding other accessories useful when golfing.

This type of bag, which serves to transport at least conventional golfing instruments over substantial distances, must be as practical as possible, so as to avoid excess fatigue for the carrier and the loss of concentration which can result from the carrying effort exerted by the golfer. Usually the bag is carried over short distances by means of a transport handle, and for longer distances, a strap connected at upper and lower points of the bag is used, the strap being situated along the same generatrix of the general cylinder which the bag usually forms, this strap overlapping the shoulder of the carrier.

For reasons of balancing the inclination of the bag on the carrier while walking, so that it is rendered as comfortable as possible, and for reasons of balancing the ultimate adaptation of the bag to the morphology of the person carrying the bag, it is conventional to provide the possibility of adjustment of the useful length of the carrying strap and/or the effective position of the lower connection point.

Furthermore, for the comfort of the person carrying the bag, it is conventional to provide a shoulder element at the upper portion of the carrying strap which may be padded if desired, and adapted to straddle the shoulder of the carrier so as to avoid excessively high contact pressures which quickly become uncomfortable and even painful. This shoulder pad can be affixed at a definitive position on the strap or on the contrary, be free to slide along the length thereof. This possible sliding, which, in principle, allows the position to be adjusted can however, occur progressively and in an undesirable manner during walking which can, in turn necessitate frequent stops for the readjustment of the position of the shoulder pad.

The adaptation of the useful length of the strap often occurs by means of a strap buckle apparatus with or without a tongue, cooperating with successive perforations provided in the strap, this buckle being connected at the lower connection point or adjacent thereto as is the case in the following patents: British 400,350; U.S. 3,521,689; U.S. 4,334,564; U.S. 2,711,201; U.S. 4,249,586; U.S. 2,072,258; U.S. 1,928,922; U.S. 1,570,510; U.S. 1,611,107; or at the upper point, as in the case of U.S. Pat. No. 1,271,784 or at an intermediate point between the upper and lower points as in U.S. Pat. No. 2,863,483.

In U.S. Pat. No. 2,861,614, the same type of buckle apparatus is found, but the lower point can furthermore be varied by degrees, and likewise, the strap can be connected to the bag at an intermediate point between the upper and lower points with the possibility of sliding at this intermediate point which, furthermore, can be varied likewise by degrees.

Another possibility of varying the length of the strap by degrees is likewise offered by British Pat. No. 1,315,943, which avoids the use of a conventional buckle.

A more elaborate adjustment apparatus is shown in U.S. Pat. No. 2,707,009. A first lower strap is connected to the lower point and at an intermediate point on the bag, and a second upper strap is connected at an upper point and at an intermediate point of the lower strap by a movable buckle tongue apparatus which is displaceable both with respect to the lower strap by modifying the position of the connection point of the upper strap on the lower strap, and likewise displaceable along the upper strap making it possible to vary its length, which can likewise be varied by a buckle present on the upper strap.

In all of the examples which have just been described, and however complex their arrangements for optimizing the equilibrium of the bag on the shoulder of the carrier, at least one conventional buckle, or an equivalent thereof is found. Furthermore, this buckle is susceptible to being accidentally caught on the clothes of the carrier, and a dead portion of the strap (between the buckle and the free end of the strap) is permitted to create a needless obstruction which can lead to the loss of concentration of the golfer.

With respect to the adjustment in position of the shoulder pad on the strap, no satisfactory practical solution has been previously proposed that would ensure the stability of this adjustment while walking.

The present invention attempts to alleviate the carrier of all disadvantages associated with the known state of the art which has just been described, and at the same time ensures the desired equilibrium of the bag for its transport and an efficient and stable adjustment of the position of the shoulder pad with respect to the strap. For this purpose, the shoulder pad has a strap which is connected at its respective ends at an upper point and a lower point of the bag and is characterized by the fact that the shoulder bag is in the form of a pocket which is elongated in the general direction of the strap and that in this pocket adjustments are positioned to adjust the length of the strap, the adjustment means being adapted to slide on the exterior of the pocket, between the pocket and at least one of the adjustment points of the strap on the bag.

BRIEF DESCRIPTION OF DRAWINGS

The characteristics of the invention and its advantages will become clear by the description of two preferred embodiments which follow, and for better comprehension of which, reference is made to annexed drawings in which.

DESCRIPTION OF PREFERRED EMBODIMENTS

Figure 1:
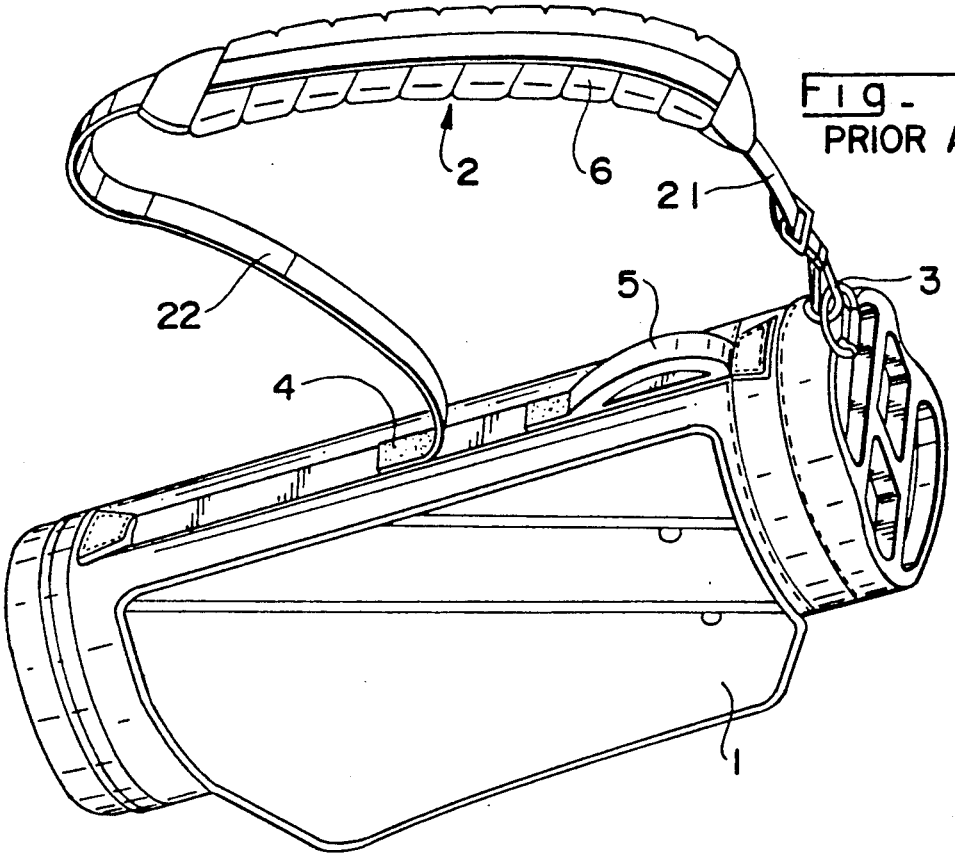
Fig. 1 PRIOR ART
FIG. 1 illustrates an isometric projection of a golf bag equipped with its carrying strap comprising a shoulder pad to which the invention can be applied.
Figure 2:
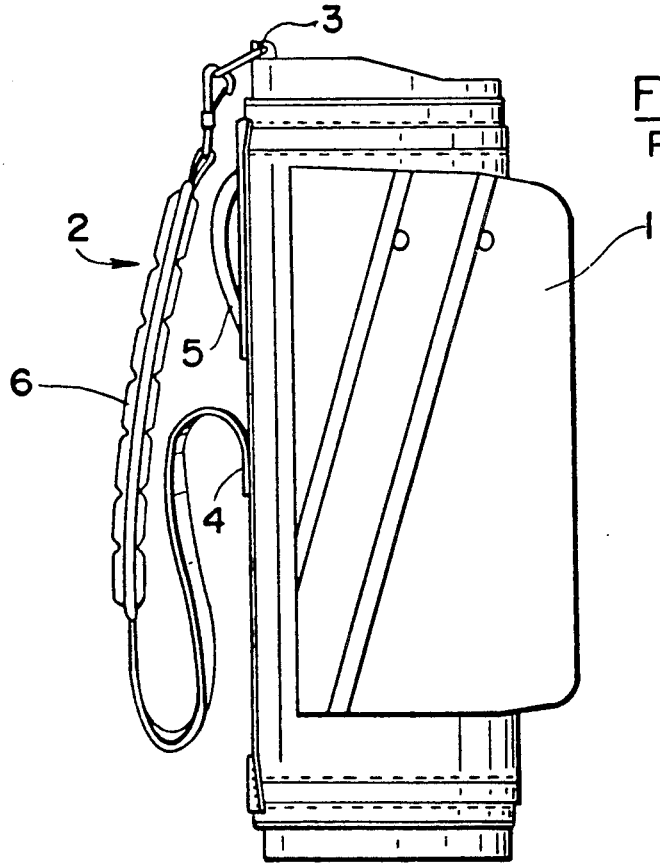
Fig. 2 PRIOR ART
FIG. 2 illustrates this same bag seen in side elevation.
Figures 3A, 3B, 3C, 3D:
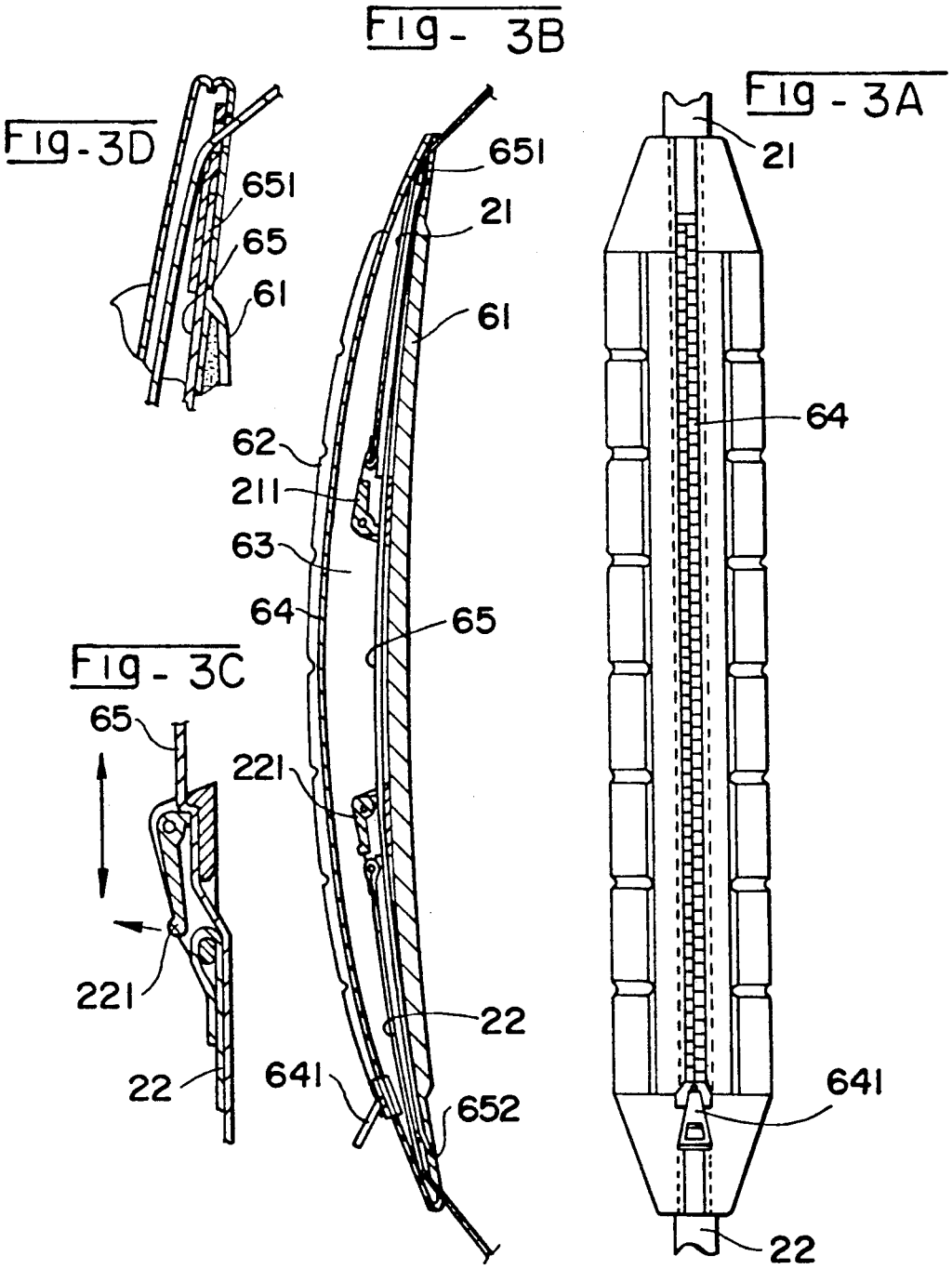
FIGS. 3A-3D illustrate a preferred embodiment of the invention with two adjustment possibilities, FIG. 3A being an exterior planar view, FIG. 3B being a longitudinal cross-sectional view, and FIGS. 3C and 3D being enlarged cross-sections of the details of FIG. 3B.

FIGS. 1 and 2 illustrate a golf bag with a carrying strap equipped with a shoulder pad according to the present invention. The golf bag is illustrated in a conventional configuration, generally cylindrical, on which at least one exterior pocket 1 is attached. For carrying, a strap 2 is attached at an upper point 3 at the upper portion of the bag, in any known manner, particularly by a hook or snap apparatus, for example. The other end of strap 2 is connected on the generatrix of the pseudo-cylinder passing through the upper point 3 to the bag at a lower point 4.

On the same generatrix as the upper and lower points 3 and 4, and as is likewise conventional, the bag has at its upper portion beneath the upper attachment point 3 a handle 5 in the form of a bridge for carrying the bag by hand. For the comfort of the carrier, and as is conventional, the carrying strap 2 is equipped with a shoulder pad 6 adapted to protect the shoulder of the carrier against excessively elevated contact pressures. It is the specific construction of shoulder pad 6 to which the instant invention relates.

One embodiment of the shoulder pad 6 according to the invention is illustrated in FIGS. 3A-3D.

Shoulder pad 6 is presented as a pocket generally elongated in the general direction of strap 2. The free portions 21 and 22 of strap 2 which are respectively connected to the upper and lower points 3 and 4, referred to previously, as is better seen in FIGS. 3A and 3B, extend into the two ends of the pocket. The shoulder pad 6 is constituted by a lower portion 61 which is more or less padded for support on the shoulder, the portion at which is superimposed an exterior portion 62, a space 63 being provided between these two portions 61 and 62 to form the interior of the pocket itself. This interior space 63 is accessible by means of a longitudinal closure apparatus 64, of the slide and cursor type 641, for example.

According to the invention, the means for adjusting the length of strap 2 are positioned in the pocket 63 is hidden from view and from any exterior influence, except by voluntary intervention after action on the closure apparatus 64, 641.

In the embodiment shown in FIGS. 3A-3D, on the interior surface of the lower portion 61 of the pocket, a strip of material 65 is positioned by forming a sort of longitudinal rail and made out of a material which is mechanically very resistant. Rail 65 is affixed at its two ends 651 and 652 to the lower portion 61 by stitching, gluing or any other appropriate means assuring a good retention, as is illustrated in detail in FIG. 3D. Ends 21 and 22 of strap 2 freely penetrate in the space 63 of the pocket by simple sliding above the respective affixation points 651 and 652 of rail 65 and are fixed at their end to a snap-hook 211, 221 respectively. These snap-hooks 211, 221, which can be of the conventional type, are provided with a latching apparatus, for example, an elbow joint type. In the unlatched position, they can freely slide the length of rail 65 to which they are connected, and, in the latched position, are effectively stopped in position on the rail 65. This construction appears best in FIG. 3C where the arrows illustrate the operation which is not necessary to further detail here.

Thus, pocket 63 being opened by moving cursor 641 along the length of slide 641 along the carrier can unlatch one or the other, (or both), snap-hooks 211, 221 to adjust the length of the corresponding free portion 21, 22 of strap 2 outside of the pocket. Once this adjustment is performed, the corresponding snap-hooks are latched and the pocket re-closed.

In FIGS. 3A-3D the adjustment of the snap-hook position 221 allows for the adjustment of the length of strap 2 between shoulder pad 6 and lower point 4 of the attachment on the bag. It is this adjustment which is most important and which will most often be performed.

The same operation for snap-hook 211 adjusts the distance between shoulder pad 6 and the upper attachment point 3, i.e., the very position of shoulder pad 6 on the shoulder of the carrier.

For less demanding users who can be satisfied with the single possibility of adjusting the length 22 of strap 2 which is free between the shoulder pad 6 and the lower attachment point 4 on the bag, portion 21 of strap 2 between shoulder pad 6 and upper attachment point 3 can simply be affixed to the lower portion 61 of the pocket, like rail 65 is at its end 651, which would avoid the use of a snap-hook 211 in this case, the construction being otherwise identical to that described above.

Figure 4:
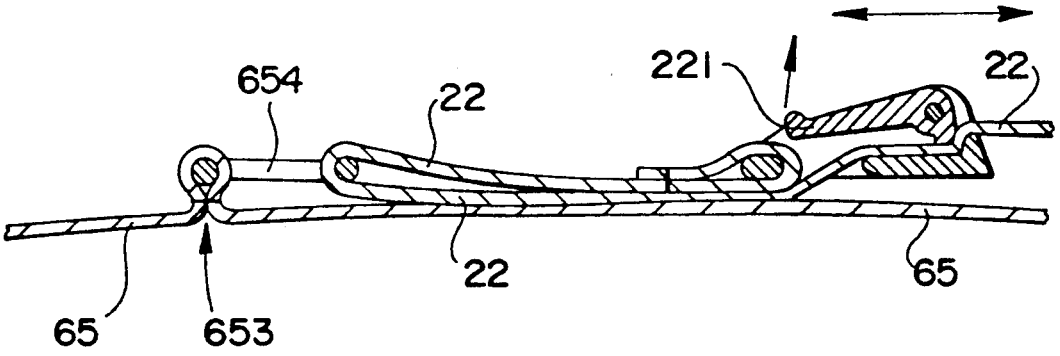
FIG. 4 illustrates a partial longitudinal cross-section of another embodiment of the invention which allows for only a single adjustment possibility, namely that of the useful length of the carrying strap.

Another embodiment to the invention with the same possibility of adjusting only the free end 22 of strap 2 between shoulder pad 6 and lower attachment point 4 is illustrated in FIG. 4. This figure is a partial longitudinal cross-sectional view which shows only the adjustment apparatus to the exclusion of the other portions of the shoulder pad which can be identical to those previously described.

In this case, the construction of the shoulder pad 6 is substantially analogous to that which has just been described immediately above, the differences relating only to the construction of the adjustment means of the length of strap 2. The strip of material 65 still affixed at its ends 651 and 652 no longer serve as a sliding rail but only as a reinforcement element assuring the continuity of the mechanical tension of the strap assembly 2, a function which it additionally likewise performs in the embodiments previously described. At an intermediate point 653 of strip 65 is affixed a return element 654 for the end portion 22 of strap 2. This return element 654 can assume the shape of a buckle or a stirrup around an arm whose portion of strap 22 is folded on itself to terminate at a snap-hook 221. The snap-hook 221 which can be of the same type as that described previously is connected to the end portion of the strap portion 22 extending from one end of pocket 63 towards the return element 654 to slide freely thereon in an unlatched state, and to be in the stopped end position in the latched state.

The manner of operating the adjustment of the length of the internal strap portion with pocket 63, thus that of strap 2 between shoulder pad 6 and lower attachment point 4 of the bag is substantially identical to that of the preceding case and needs no further explanation.

It should be noted that a second adjustment apparatus identical to that which has just been described can likewise be provided with respect to the other end of the shoulder pad, which one of ordinary skill in the art can obviously conceive of without further explanation.

Figure 6:
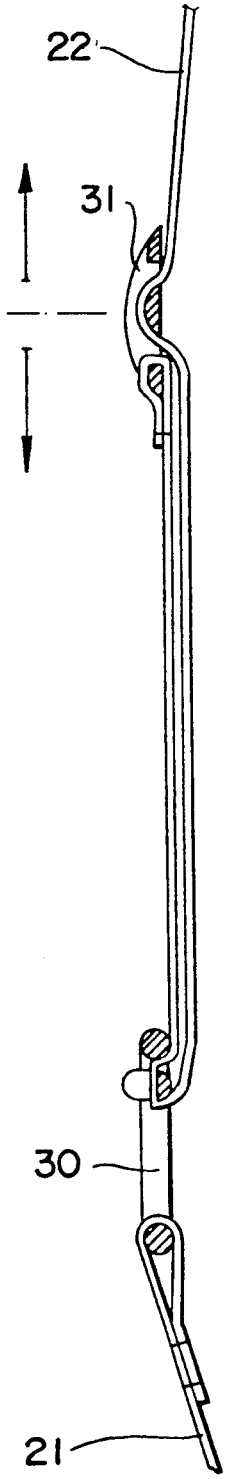
FIGS. 5 and 6 illustrate in longitudinal cross-section another embodiment of the invention.
Figure 5:
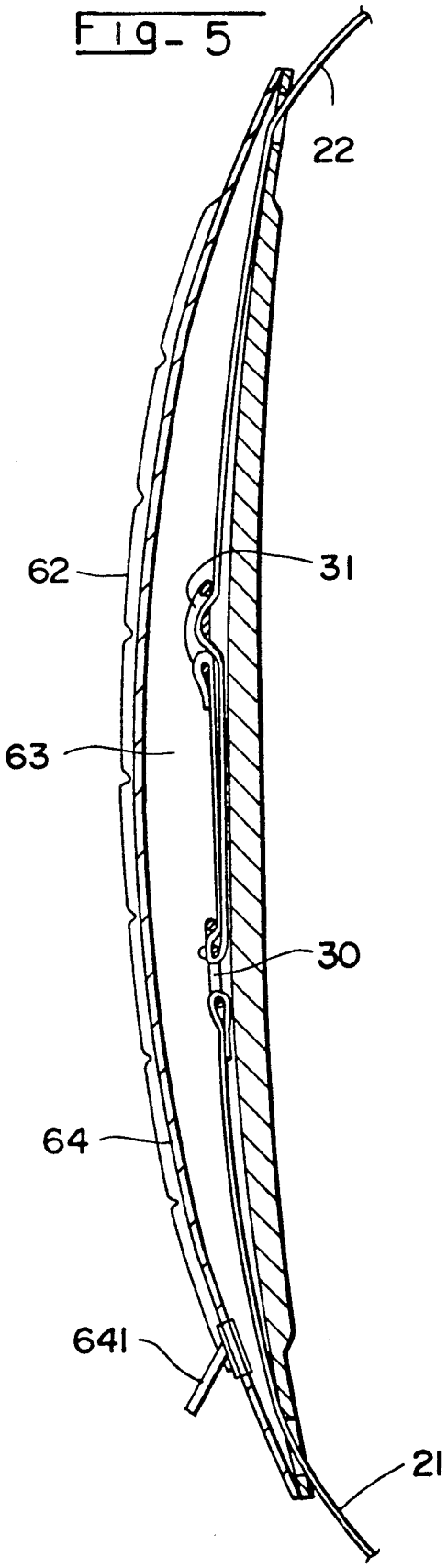

FIGS. 5 and 6 illustrate another embodiment to the invention in which the adjustment means do not slide on a reinforcement strip but are carried by the strap 2. A first portion 21 or freely penetrates into the space 63 of the pocket at one of its ends by simple sliding and is affixed to a self-blocking buckle 30. The second portion 22 of the strap 2 cooperates within the self-blocking buckle 30, and the end of the second portion 22 is furthermore affixed to a sliding buckle 31 on the return portion of its length.

In the preceding description it is observed that the invention, while assuring the possibility of adjustment of the useful length of strap 2 does not allow, on the exterior of shoulder pad 6, any dead portion of the strap nor any adjustment element which, besides their unattractive appearance, would always be capable of getting caught on the clothing of the wearer or other objects and creating a needless obstruction which might lead to the loss of concentration of the carrier.

Of course, the present invention is not limited to golf bags and can be adapted to any other type of bags such as back packs having straps in the form of shoulder straps for example.

This application is related to French Application No. 89.16070 whose priority is claimed, the disclosure and drawings of which is hereby incorporated by reference thereto.

Finally, although the invention has been described with reference in particular means, materials and embodiments, it is to be understood that the invention is not limited to the particular disclosed and extends to all equivalents within the scope of the claims.

What is claimed is:

1. A carrying arrangement comprising:

a shoulder pad and strap for carrying an object, said strap being adapted to be connected to the object at first and second spaced points, said shoulder pad comprising a pocket, said pocket being elongated along the general direction of said strap, at least a portion of said strap extending within said pocket, means contained within said pocket for adjusting a length of said portion of said strap extending within said pocket.

2. The carrying arrangement of claim 1, said pocket comprising a shoulder-engaging portion and an overlying portion, an interior space being formed between said shoulder-engaging portion and said overlying portion within which said portion of said strap extends, said overlying portion of said pocket having a longitudinal closure apparatus for facilitating access to said interior space.

3. The carrying arrangement of claim 2, said closure apparatus being of the slide fastener type.

4. The carrying arrangement of claim 2, further comprising a strip of reinforcing material having a pair of ends which are affixed to end portions of said shoulder-engaging portion of said pocket.

5. The carrying arrangement of claim 4, said portion of said strap extending within said pocket being in sliding engagement within said pocket at at least one of said end portions of said shoulder-engaging portion of said pocket, adjacent at at least one of said ends of said strip of reinforcing material, said carrying arrangement further comprising a snap-hook longitudinally movable and immobilizable within said pocket, said portion of said strap having an end affixed to said snap-hook.

6. The carrying arrangement of claim 5, said snap-hook comprising a latching apparatus movable from a latched, frictionally engaged position with said strip of reinforcing material for immobilizing said snap-hook on said strip of reinforcing material, and an unlatched, disengaged position with said strip of reinforcing material for facilitating repositioning of said snap-hook along said strip of reinforcing material.

7. The carrying arrangement of claim 5, said means for adjusting a length of said portion of said strap further comprising a return element within said pocket, said portion of said strap extending within said pocket forming a first section extending to said return element and a second section extending from said return element, said first section overlying said second section, said snap-hook being slidably positioned and selectively latchable and unlatchable on said first section.

8. The carrying arrangement of claim 1, said means contained within said pocket for adjusting a length of said portion of said strap further comprising a self-blocking buckle within said pocket, said portion of said strap extending within said pocket forming a first section extending to said self-blocking buckle and a second section extending form said self-blocking buckle, said first section overlying said second section, said second section being affixed to a sliding buckle, said sliding buckle being slidably engaged along said first section.

9. The carrying arrangement of claim 1, said shoulder pad having an end which is non-adjustable in relation to said object to be carried.

10. The carrying arrangement of claim 9 in combination with said object, said object comprising a bag, said bag having an upper portion and a lower portion, said non-adjustable end of said shoulder pad being connected to said upper portion of said bag.

11. The carrying arrangement of claim 1, said pocket having a first end and a second end, said portion of said strap extending into said first end of said pocket, said strap comprising a second portion extending into said second end of said pocket, said means contained within said pocket for adjusting a length of said portion of said strap extending within said pocket further comprising means for adjusting a length of said second portion of said strap.

12. The carrying arrangement of claim 11 in combination with said object, said object comprising a bag.

13. The carrying arrangement of claim 1 in combination with said object, said object comprising a bag.

14. The carrying arrangement of claim 13, said bag being a golf bag.

15. A carrying arrangement comprising:

a shoulder pad and strap for carrying an object, said strap being adapted to be connected to the object at first and second spaced points, said shoulder pad comprising a pocket, said pocket being elongated along the general direction of said strap, at least a portion of said strap extending within said pocket, means within said pocket for adjusting a length of said portion of said strap extending within said pocket, said means comprising a fastener longitudinally repositionable within said pocket, said portion of said strap being connected to said fastener.

16. The carrying arrangement of claim 12 in combination with said object, said object comprising a bag.

17. A carrying arrangement comprising:

a strap adapted to be connected to an object to be carried;

a pocket having an opening into which a length of said strap extends; and means for adjusting said length of said strap within said opening, said means for adjusting contained entirely within said pocket.

18. A carrying arrangement comprising:

a strap adapted to be connected to an object to be carried;

a pocket having an opening into which a length of said strap extends; and means for adjusting said length of said strap within said opening, said means for adjusting comprising a longitudinally repositionable element within said pocket, said longitudinally repositionable element being attached to said strap for varying said length of said strap within said opening and for varying a length of said strap extending from said opening of said pocket.

19. The carrying arrangement of claim 18, said strap comprising a first portion and a second portion, said length of said strap comprising a length of said first portion, said pocket further comprising a second opening, said second portion of said strap comprising a length extending into said second opening of said pocket, said arrangement further comprising means for adjusting said length of said second portion of said strap.

20. The carrying arrangement of claim 18, said pocket comprising a further opening for permitting access to said means for adjusting, and means for closing said further opening.

21. The carrying arrangement of claim 20, said means for adjusting being entirely contained within said pocket.

* * * * *